US006513659B1

(12) United States Patent
Ogura et al.

(10) Patent No.: US 6,513,659 B1
(45) Date of Patent: Feb. 4, 2003

(54) PRESERVATION CONTAINER FOR FOOD AND THE LIKE

(75) Inventors: Akira Ogura, Aichi (JP); Takakazu Hirata, Tokyo (JP); Moriya Tanaka, Aichi (JP)

(73) Assignees: Santoku Inc., Aichi (JP); Mitsui Kanko Trading Corporation, Tokyo (JP)

( * ) Notice: Subject to any disclaimer, the term of this patent is extended or adjusted under 35 U.S.C. 154(b) by 0 days.

(21) Appl. No.: 09/623,518

(22) PCT Filed: Jan. 14, 2000

(86) PCT No.: PCT/JP00/00149

§ 371 (c)(1),
(2), (4) Date: Oct. 2, 2000

(87) PCT Pub. No.: WO00/46120

PCT Pub. Date: Aug. 10, 2000

(30) Foreign Application Priority Data

Feb. 5, 1999 (JP) ..... 11-28884

(51) Int. Cl.[7] ..... B65D 81/20
(52) U.S. Cl. ..... 206/524.8; 426/106; 215/262
(58) Field of Search ..... 206/524.8, 438; 426/106, 118; 53/432, 433, 434; 220/203.16, 367.1, 745, 212, 231, 254, 371; 215/228, 262, 270, 310

(56) References Cited

U.S. PATENT DOCUMENTS

| | | | | | |
|---|---|---|---|---|---|
| 793,107 | A | * | 6/1905 | Staunton | 215/262 |
| 5,566,854 | A | * | 10/1996 | Rojek | 220/357 |
| 5,584,409 | A | * | 12/1996 | Chemberlen | 220/89.1 |
| 5,587,192 | A | * | 12/1996 | Beizermann | 426/118 |
| 5,833,090 | A | * | 11/1998 | Rojek | 215/262 |
| 5,989,608 | A | * | 11/1999 | Mizuno | 426/113 |
| 6,023,915 | A | * | 2/2000 | Colombo | 53/432 |
| 6,051,263 | A | * | 4/2000 | Gorlich et al. | 426/129 |

FOREIGN PATENT DOCUMENTS

JP 4-60848 5/1992

* cited by examiner

*Primary Examiner*—Shian Luong
(74) *Attorney, Agent, or Firm*—Rader, Fishman & Grauer, PLLC

(57) ABSTRACT

A preservation container for food and the like comprising a sealable container main body (2), to which a lid (3) is attached, an opening (5) connecting the inside and the outside is provided on the lid (3), and a gas non-permeable sheet (6) having a vent hole (7) at a position offset to the opening (5) is arranged to cover the opening (5). When the pressure inside the container is reduced, the sheet (6) is curved toward the inside at a part corresponding to the opening (5) and is adhered and retained on the outer surface of the lid (3).

11 Claims, 6 Drawing Sheets

(A)

(B)

PRESERVATION CONTAINER FOR FOOD AND THE LIKE

TECHNICAL FIELD

The present invention relates to a preservation container for food and the like, and more particularly, relates to a preservation container for food and the like that is capable of prolonging a preservation period of food and the like.

BACKGROUND OF THE INVENTION

With the progress of the trends toward the nuclear family and the decrease in number of children, it has been often employed a way in that a large amount of perishable food is purchased at a time and it is consumed over a certain period of time. In the case of food stuffs that are difficult to be prepared in a small amount, there are cases where an amount thereof for several meals has been prepared at a time and it is consumed by small portions over a certain period of time. In such a treatment of food, it is preferred to preserve food and the like in a long period of time without substantial spoilage, and thus it is an important problem how to preserve food and the like in a long period of time.

Food in the form of dry provisions, such as dry laver, medical herbs, dry confectionery and the like, has a property in that it is spoiled by absorbing moisture when it is allowed to stand in a long period of time. Therefore, in this case, it is also an important problem how to preserve in a long period of time without spoiling the original taste thereof.

It is general that prepared food set at a hotel, a restaurant, a school lunch and the like is prepared on having a meal. However, in the case where a large amount of orders have been previously received, and the menu has been fixed, it is generally often employed a method where a large amount of food has been previously prepared and preserved, which is used by opening a package on setting because the setting is delayed when prepared immediately before having the meal. In this case, while a longer period of time from the preparation to the setting makes easy the management of the food, there is a problem in that a long period of time cannot be applied since degrading and spoilage of the food proceed when the period is too long.

It is a current topic that a poison and the like are mixed on preserving prepared food to cause a large number of casualties. However, it has been difficult to prevent such an incident by previously detecting the mixed poison in the conventional preservation method.

Pollution of the global environment by wastes from homes is a current problem, and the wastes include spoiled food that has been preserved, used empty bottles and empty cans of bottled food and canned food, and the like. A large cost is being consumed to treat the wastes in local public organizations, and there is a strong demand of decreasing the cost.

DISCLOSURE OF THE INVENTION

An object of the invention is to solve the problems associated with the conventional art and to provide a preservation container for food and the like that is capable of preserving food in a long period of time without spoiling food.

Another object of the invention is to provide a preservation container for food and the like, by which the formation of wastes caused by spoilage of food, wastes of used container, and the like is suppressed, so as to suppress as possible the costs of an incinerating equipment for treating the wastes and recovering the wastes.

A further object of the invention is to provide a preservation container for food and the like, by which used empty bottles and empty cans of bottled food and canned food can be subjected to effective reuse without wasting, so as to contribute to conservation of the environment.

A still further object of the invention is to provide a preservation container for food and the like, by which in the case where a food package is opened without permission during the preservation thereof, such a fact can be easily confirmed to prevent an accident.

A still further object of the invention is to provide a lid member for sealing and/or a sheet for sealing utilized as a part of a preservation container for food and the like.

A preservation container for food and the like of the invention attaining the objects is characterized by comprising a sealable container having an opening at a part thereof, and a gas non-permeable sheet arranged outside the opening, the sheet having an area larger than the opening and having a vent hole at a position offset to the opening, wherein the sheet is curved and deformed at a part corresponding to the opening, and a peripheral part thereof around the opening is adhered and maintained on a surface of the container by pressure reduction of an interior of the container. More preferably, the container comprises a container main body and a lid, and the opening is provided in the lid. It is preferred that the container main body comprises a bottle comprising one of glass and plastics.

According to the preservation container of the invention, since food is contained and subjected to a reduced pressure condition, oxidation spoilage of the food can be delayed by decreasing active oxygen inside the container. Because the increase of bacteria and the like are prevented by the decrease of active oxygen, food and the like can be stably preserved in a long period of time without spoilage. By such preservation in a long period of time, formation of kitchen garbage due to spoilage of food and the like is suppressed, so as to contribute to reduction in the cost for treating the garbage.

Furthermore, the taste of food can be changed by making the interior of the container into a reduced pressure condition. For example, when vegetables and the like are preserved with a small amount of salt to make light pickles, light pickles can be obtained in an extremely short period of time in comparison to the time required for forming ordinary light pickles, and furthermore the taste can be made delicate. When liquors, such as Japanese sake, wine, shochu and the like, or drinks and food containing a sweetening agent are preserved, stimulative acidity or strong sweetness is disappeared from the liquors or drinks and food, and the taste can be changed very delicate.

When the interior is made a reduced pressure condition, the sheet arranged on the outer surface of the lid is curved and deformed toward the inside at the opening, and thus it can be easily confirmed as to whether or not the package is opened without permission during the preservation by observing the presence or absence of the curved deformation. Furthermore, the lid cannot be opened with a small force since it is sealed under a reduced pressure condition, and thus the presence or absence of the unauthorized opening can be known by the extent of the resistance force on opening.

When the container main body is constituted as a bottle, to which a lid is connected to the bottle by screwing, an empty bottle, which has been a waste, can be reused as the container main body as far as the dimension of the screw part is the same, so as to contribute suppress of waste pollution. Furthermore, when the container main body is constituted with a can without unevenness and deformation at the upper end thereof, and a packing material for sealing the lid is in contact with the hole body, an empty can, which has been a waste, can be reused as the container main body.

BEST MODE FOR CARRYING OUT THE INVENTION

Figure 1:
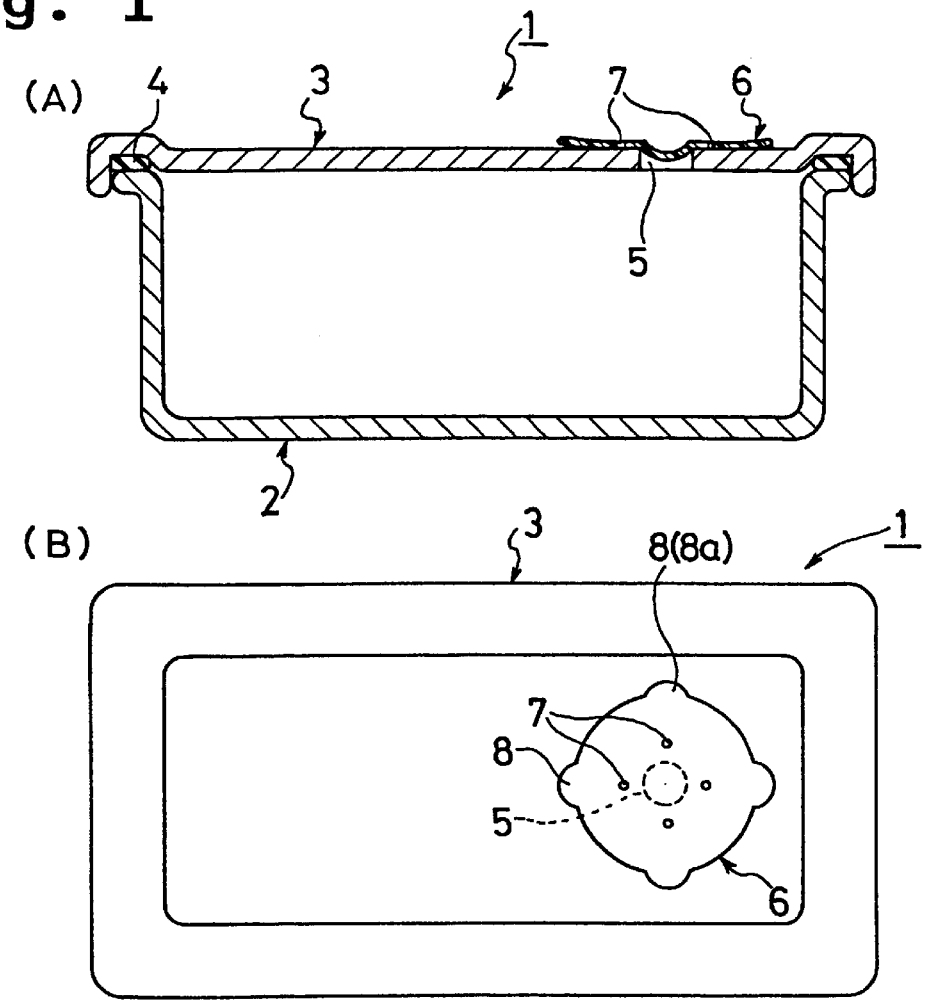
FIG. 1 shows a preservation container for food and the like of an embodiment of the invention, in which (A) is a vertical cross sectional view, and (B) is a plan view.

The food and the like in the invention include perishable food, such as vegetables, fruits and the like, prepared food after cooking, dry provisions, such as dry laver, medical herbs, dry confectionery and the like, powder, such as soybean flour, wheat flour and the like, desserts, seasonings, such as miso, soy sauce, Worcester sauce, condensed soup and the like, and drinks, as well as medical drugs.

In the invention, the container is not particularly limited in the shape thereof as far as it has such a structure that can be sealed in the part other than a part, at which an opening is provided. Preferably, it comprises a container main body and a lid that is freely opened and closed on the container main body, so as to make putting and withdrawing of food easy. One having a packing material seal for sealing between the container main body and the lid is more preferred. The packing material seal for sealing may be attached to the lid or attached to the container main body.

The size of the container is not particularly limited, and it can be applied to a small size for home use and a large size for commercial use. For example, it can be applied to a size of a sample bottle as the small size and to a size of a hotel pan as the large size. The material for constituting the container may be any of glass, plastics, metal, pottery and the like.

The opening provided in the container is not particularly limited in the shape, number and size thereof as far as it can adhere and retain the sheet for sealing by the reduced pressure of the interior when it is covered with the sheet for sealing. The shape is preferably a circular shape, and an elliptical shape, a polygonal shape, such as a triangular shape, a rectangular shape and the like, a stellar shape, a slit shape and the like may be employed.

The number of the opening provided may be one or plural. In the case where one opening is provided, the productivity of the container is good, and in the case where plural openings are provided, the adsorption and retaining property can be improved since a tension can be effected on the sheet for sealing among the adjacent openings. In the case where plural openings are provided, the size and shape of the openings may be the same as or different from each other.

It is suitable that the opening has such a size that the maximum distance across the opening (diameter in the case of a circular shape) is from 3 to 15 mm. When the maximum distance is less than 3 mm, the curved deformation of the sheet for sealing becomes small, and it becomes difficult to confirm by the naked eye as to whether or not the sheet is curved. Of course, while the sheet does not cause curved deformation with such a small opening, an adsorption force is formed, and thus there is no restriction to provide such an opening as an auxiliary of a large opening capable of causing curved deformation of the sheet.

The maximum distance of the opening may be more than 15 mm, but the required area of the sheet for sealing becomes excessive, which is uneconomical in view of the cost. Furthermore, as a result of the too large size of the sheet, a suction apparatus becomes large size, which is hard to handle. As a result of the too large size of the sheet, since sheet is strongly attracted toward the opening, an edge part of the sheet is liable to rise and is peeled off or is liable to be peeled off by contact with an obstacle during transportation of the container.

The position of the container where the opening is provided is preferably an upper surface for improving the maintaining property of the sheet for sealing, and the upper surface of the lid is particularly preferred. It is suitable that the wall part where the opening is provided is formed into a concave shape. When the concave part is formed, into which the sheet for sealing is contained, the adsorption and retaining property of the sheet becomes good.

The container used in the invention preferably comprises a bottle comprising glass or plastics as the container main body, to which a lid having an opening is connected by screwing. More preferably, a so-called wide-mouthed bottle having a wide opening is used as the bottle. The glass or plastics are preferably a transparent material, through which the interior of the bottle can be seen, and more preferably, a heat resistant material, by which heated food can be preserved. The size of the bottle may be formed as a small size for home use and a large size for commercial use. For example, as a large size one, an about 5-L size for pickling plum can be applied.

The material of the lid may be metal, as well as glass, plastics and the like. In particular, glass and plastics are preferably transparent. The shape of the lid is basically a circular shape for screwing into the opening of the bottle, and it is not restricted to provide a non-circular shape from a plan view at the part other than the screw part. In the case of a large size lid, it is preferred to make the entire body thick or to provide ribs for preventing deformation of the lid.

The shape and the size of the opening provided on the lid are not particularly limited as far as when it is covered with the sheet for sealing and the interior pressure is reduced (negative pressure), the sheet can be adhered and retained. The shape is preferably a circular shape, and an elliptical shape, a polygonal shape, such as a hexagonal shape and the like, and the like may be employed.

The sheet for sealing used in the invention comprises a gas non-permeable flexible material for sealing the opening. It is preferably an elastic material having an elastic recovering property, by which a flat state and a curved deformation state can be alternately repeated. As the elastic material, one having a heat resistance that withstands a high temperature of prepared food immediately after cooking is more preferred.

Examples of the material for the sheet include silicone rubber, a thermoplastic polymer elastomer, synthetic or natural rubber and the like, and silicone rubber is particularly preferred. Examples of the thermoplastic polymer elastomer include a polyamide series elastomer, a polyurethane series elastomer, a polyester series elastomer, a polyolefin series elastomer, a styrene block series elastomer and the like.

The sheet for sealing preferably has a thickness of about from 0.5 to 3 mm, and more preferably about from 0.7 to 1.5 mm. The shape is not particularly limited as far as it covers the opening provided on the lid, and for example, a circular shape, an elliptic shape, a polygonal shape and the like can be employed, with the circular shape being preferred. The area of the sheet must be larger area than the opening for covering the entire opening. In the case where plural openings are provided on the lid, it must have an area that can cover all the openings at a time.

In the sheet for sealing, a vent hole is provided at a position offset to the position corresponding to the opening of the container. As described later, the vent hole is used as an exhaust hole for exhausting a gas inside the container upon conducting suction operation to adhere and retain the sheet for sealing on the lid. While the shape and the size of the vent hole are not particularly limited, the shape is preferably a circular shape, and the size may be sufficiently smaller than the opening of the lid. For example, the diameter may be about from 0.3 to 2.0 mm.

The fitting surfaces where the sheet for sealing is adhered on the upper surface of the container (lid) are preferably mirror surfaces on both the sheet side and the container side since the sealing property is improved. More specifically, the outer surface of the container and the sheet are preferably a mirror surface having a surface roughness of 0.2 S or less. The edge of the opening provided on the container (lid) is preferably chamfered to have a curved surface. By chamfering to have a curved surface, the sheet for sealing can be prevented from injuring due to stress concentration at the edge of the opening.

In the invention, the pressure reduction operation for making the interior of the container to have a negative pressure can be conducted as follows.

After putting a lid on a container main body, an opening of the lid is covered with a sheet for sealing, and a suction port of a suction apparatus is attached to the outer surface of the sheet. The suction apparatus is attached in such a manner that the opening of the lid and the vent hole of the sheet for sealing are positioned inside the suction port. When the pressure reduction operation is conducted by sucking with the suction apparatus, the sheet for sealing falls into a state of being blistered toward the inside of the suction port, and the air inside the container is sucked out to the outside from the opening through the vent hole of the sheet for sealing, so that the interior of the container is in a negative pressure state. After the pressure inside the container reaches the prescribed negative pressure, the suction is terminated, so that the sheet for sealing is adhered on the outer surface of the lid and is adhered and retained in a state where it is curved and deformed toward the inside at the part corresponding to the opening. Then, under the state where the sheet for sealing is adhered and retained, the suction apparatus is removed.

When the sheet for sealing is adhered on the container, miscellaneous bacteria do not invade into the container, and bacteria are not increased. Since the amount of active oxygen in the interior is reduced by the forced suction operation, the oxidation reaction of food or the like is delayed, so as to maintain freshness for a long period of time. In the case of dry provisions, such as dry laver, medical herbs, dry food, confectionery and the like, powder, such as soybean flour and the like, and the like, which are liable to absorb moisture, are preserved, the absorb of moisture is suppressed, so as to maintain the taste thereof for a long period of time. Furthermore, as described in the foregoing, the taste of the food and the like can be changed by making the interior of the container to have a negative pressure.

In the preservation container of the invention, because the sheet arranged on the outer surface of the lid is curved inside owing to the interior negative pressure, it can be easily confirmed as to whether or not the package has been opened without permission during the preservation thereof by observing the presence or absence of the curved deformation. Because the lid cannot be easily opened with a small force by adhering the container main body and the lid, the presence or absence of unauthorized opening can be known by the extent of the resistance force on opening.

In the case where a bottle is used as the container main body, to which a lid is screwed, the combination of the lid and the sheet for sealing can be applied a bottle having a screw part having the same dimension, and therefore an empty bottle, which has been wasted, can be effectively reused.

The invention will be described with reference to embodiments shown in the drawings.

In FIG. 1(A) and (B), a container 1 is a hotel pan (food canister) made of stainless steel, which comprises a main body 2 having a substantial rectangular shape as a plan view and a lid 3. The lid 3 has a packing material seal 4 for sealing inside the outer periphery, and can be attached and removed to seal the container main body 2 through the packing material seal 4. The interior pressure of the container thus sealed is to be reduced by the pressure reduction operation described later.

An opening 5 connecting the inside and the outside the container 1 is provided on the lid 3, and a gas non-permeable sheet for sealing 6 is arranged on the upper surface to close the opening 5. The sheet for sealing 6 is curved to a concave form at a position corresponding to the opening 5 when the interior of the container is of a negative pressure, and a position not corresponding to the opening 5 is adhered to the upper surface of the lid 3 to be adhered and retained.

The sheet for sealing 6 has four protruded parts 8*a* on the outer periphery thereof, and the protruded parts 8*a* is used as peeling assisting parts 8. On peeling the sheet for sealing 6 adhered on the surface of the lid 3, the sheet for sealing 6 can be easily peeled by picking and pulling upward the protruded part 8*a*.

Four vent holes 7 are provided on the sheet for sealing 6 at positions offset to the opening 5. As described later, the vent hole 7 is utilized as a pass, through which an internal gas is evacuated, upon reducing the pressure inside the container 1.

Figure 2:
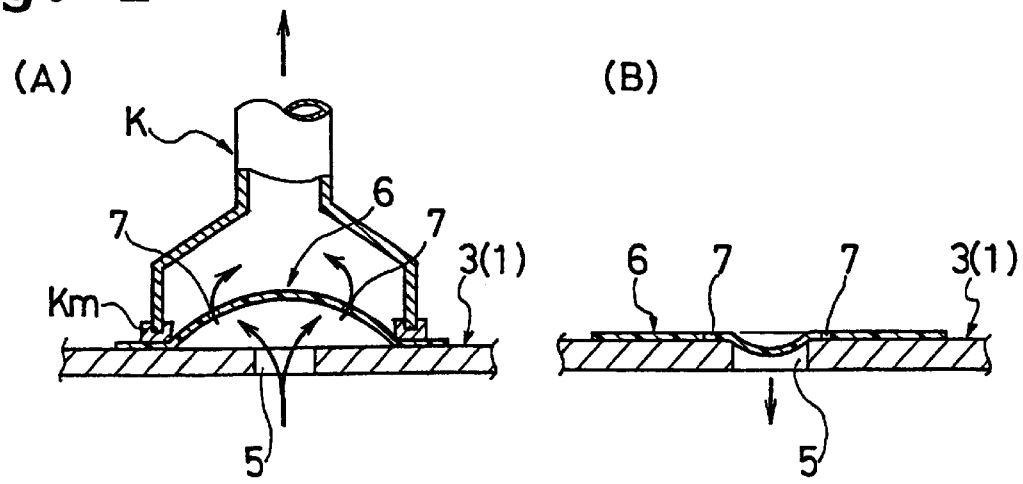
FIG. 2 is an explanatory view of pressure reduction operation of a preservation container of the invention, in which (A) is a vertical cross sectional view of a sheet part for sealing on the pressure reduction operation, and (B) is a vertical cross sectional view of a sheet part for sealing after the pressure reduction operation.

The pressure reduction operation for making the interior of the container 1 to have a negative pressure is conducted as shown in FIG. 2(A) and (B).

The sheet for sealing 6 is arranged on the upper surface of the lid 3 to cover the opening 5 and to offset the vent holes 7 to the opening 5. A suction port Km of a suction apparatus K is then attached to the outer surface of the sheet 6. At this time, the suction port Km is set in such manner that the opening 5 and the vent holes 7 are enclosed inside the suction port Km.

When the air is sucked by the suction apparatus K, the sheet for sealing 6 is curved to rise toward the suction side as shown in FIG. 2(A), and the air inside the container is sucked out from the opening 5 through the vent holes 7 as shown by the arrow, whereby the interior of the container is in a negative pressure state by suction.

When the suction is terminated, since the interior of the container has been in a negative pressure, the sheet for sealing 6 is pulled back to the container side, so as to adhere on the upper surface of the lid 3, as shown in FIG. 2(B),and also the part corresponding to the opening 5 is curved to a concave form toward the inside of the container.

Figure 5:
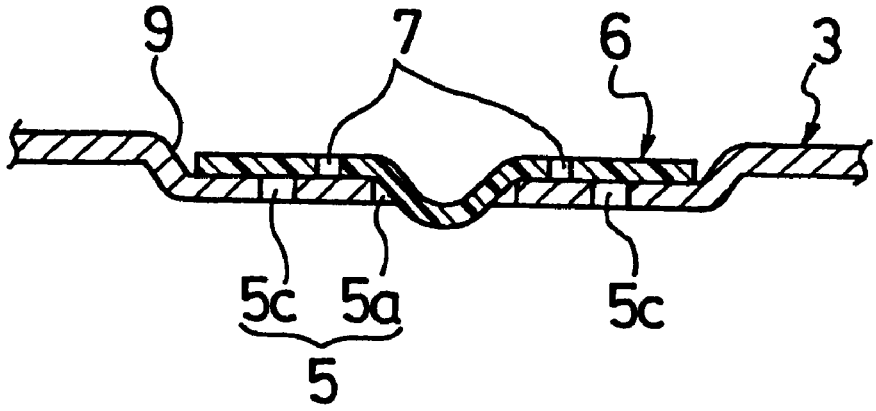
FIG. 5 is a vertical sectional view of a sheet part for sealing of a preservation container of a further embodiment of the invention.

The lid 3, on which the sheet for sealing 6 is put, may be provided with plural openings 5*a* and 5*c* as the opening 5 provided herein as shown in FIG. 5. Furthermore, the parts where the plural openings 5*a* and 5*c* are provided are formed into concave part 9, and the sheet for sealing 6 may be contained in the concave part 9. When the sheet 6 is contained in the concave part 9, the sheet 6 can be retained without peeled off from the upper surface of the container even after the negative pressure inside the container is disappeared, whereby miscellaneous bacteria can be prevented from invasion from the opening 5.

Figure 3:
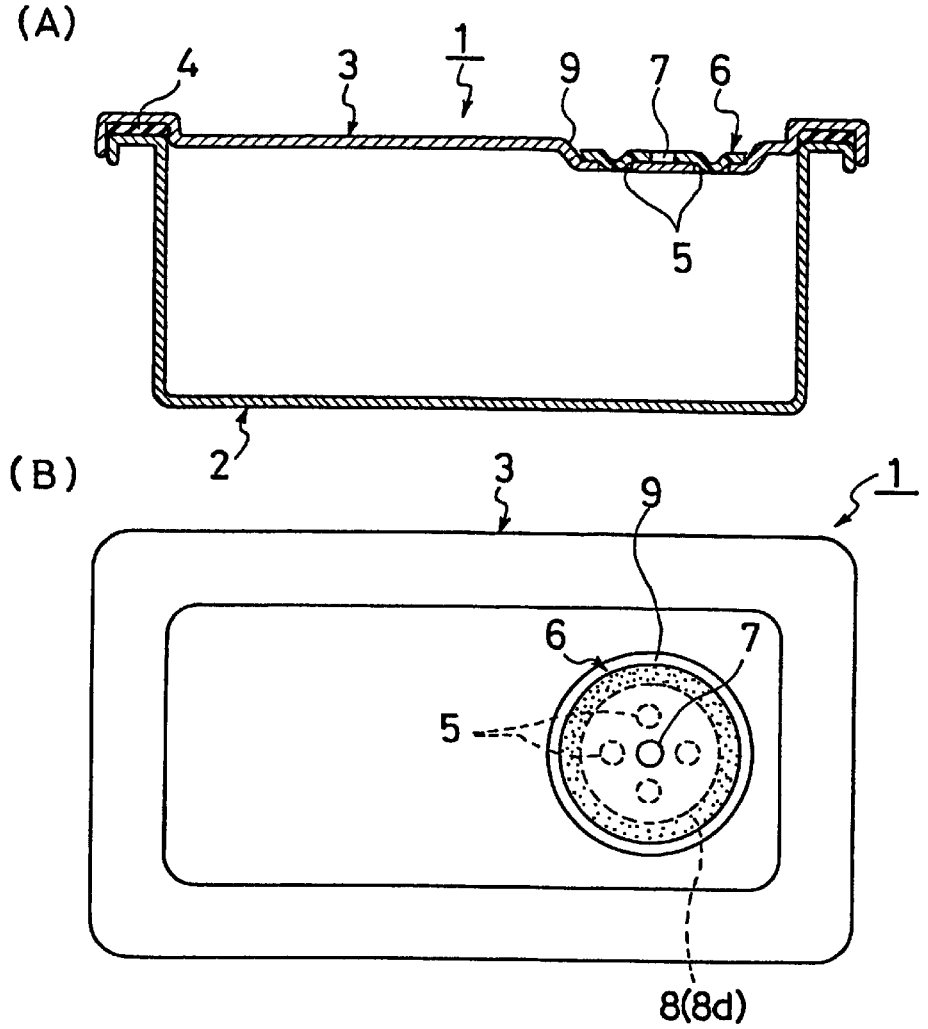
FIG. 3 shows a preservation container for food and the like of another embodiment of the invention, in which (A) is a vertical cross sectional view, and (B) is a plan view.

FIG. 3(A) and (B) show another embodiment of the invention. While a container 1 is a hotel pan as s similar to FIG. 1(A) and (B), the number of openings 5 provided on the lid 3 is four, and the size thereof is smaller than the case of FIG. 1(A) and (B). Furthermore, one vent hole 7 is provided at the center of a sheet for sealing 6, and the outer periphery of the back surface thereof is a satin finished rough surface 8*d*, which functions as a peeling assisting part 8. A part of the lid 3 where the openings 5 are formed is formed into a concave part 9 having a flat bottom, and the sheet for sealing 6 is contained in the concave part 9. The sheet for sealing 6 is curved and deformed toward the inside at each of the parts of the four openings 5 and is adhered on the upper surface of the lid 3 to be adhered and retained at the part other than the openings 5.

Figure 4:
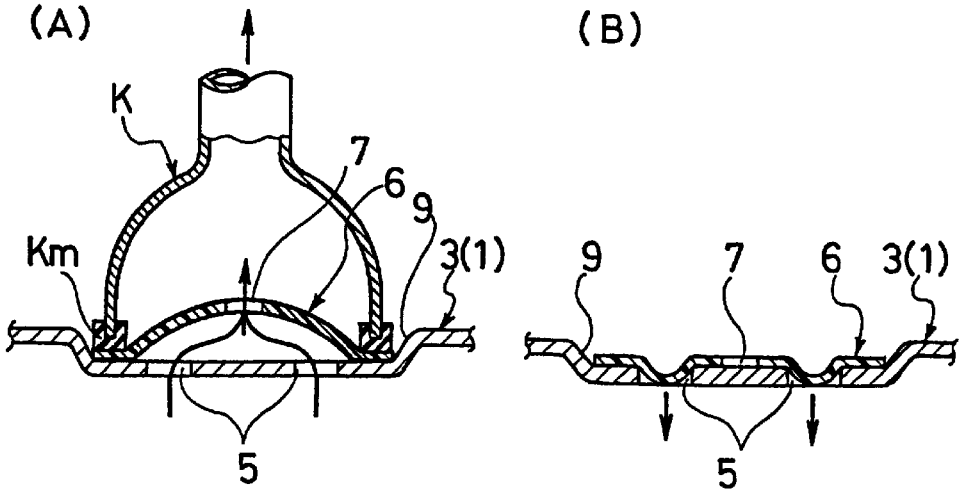
FIG. 4 is an explanatory view of pressure reduction operation of a preservation container of FIG. 3, in which (A) is a vertical cross sectional view of a sheet part for sealing on the pressure reduction operation, and (B) is a vertical cross sectional view of a sheet part for sealing after the pressure reduction operation.

The pressure reduction operation for making the interior of the container 1 to have a negative pressure is conducted as shown in FIG. 4(A) and (B), which is substantially the similar to FIG. 2(A) and (B).

The sheet for sealing 6 is arranged on the concave part 9 of the lid 3 to cover the openings 5, and a suction port Km of the a suction apparatus K is then attached to the outer surface of the sheet 6, whereby the openings 5 and the vent hole 7 are enclosed inside the suction port Km. When the air is sucked by the suction apparatus K, the sheet for sealing 6 is curved to rise toward the inside of the suction port as shown in FIG. 4(A), and the air inside the container is sucked out from the openings 5 through the vent hole 7 as shown by the arrow, whereby the interior of the container is in a negative pressure state. When the suction is terminated, the sheet for sealing 6 is curved and deformed toward the inside of the container at the positions of the openings 5 as shown in FIG. 4(B), and adhered on the upper surface of the lid 3 to be adhered and retained.

FIG. 6(A) and (B) shows the case where a wide-mouthed bottle comprising glass or plastics is used as a container main body 2. A lid 3 comprises a metal, and a sheet for sealing 6 comprising a silicone resin is arranged on the upper surface thereof. The metallic lid 3 has female screw Sf on the outer periphery and retains a packing material seal 4 for sealing on the inside thereof, and the container main body 2 has a male screw Sm at the opening, whereby both of them are connected by screwing to each other.

An opening 5 connecting the inside and the outside is provided on the lid 3, and a sheet for sealing 6 is arranged on the upper surface of the lid 3 to close the opening 5. In the sheet for sealing 6, plural (four in the figure) vent holes 7 are provided at a constant interval at positions offset to the opening 5 in the radial direction. When the interior of the container is of a negative pressure by the suction operation, as shown in FIG. 7, the sheet for sealing 6 is curved toward the inside at the part corresponding to the opening 5 and is adhered to the upper surface of the lid 3 at the position around the opening 5 to be adhered and retained.

Figure 7:
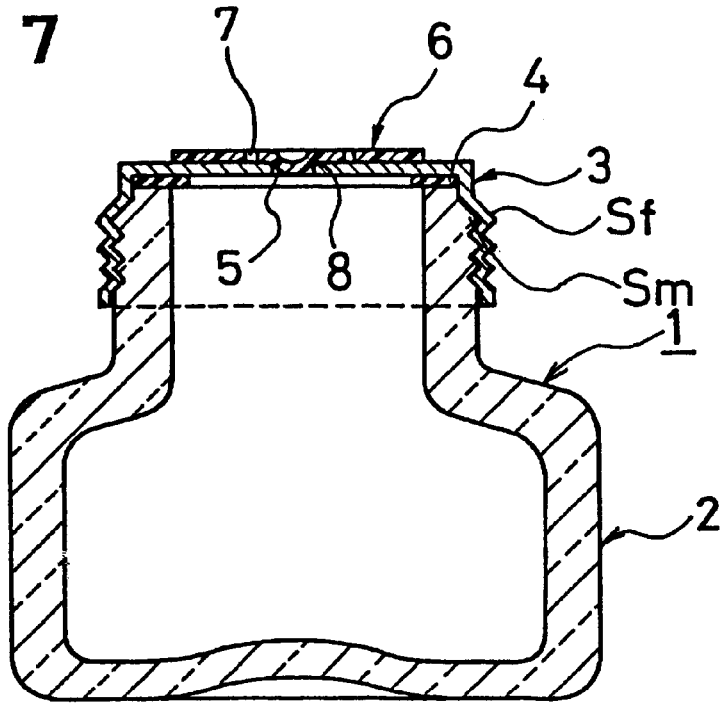
FIG. 7 is a vertical cross sectional view showing the state of the preservation container of FIG. 6 after the pressure reduction operation.
Figure 8:
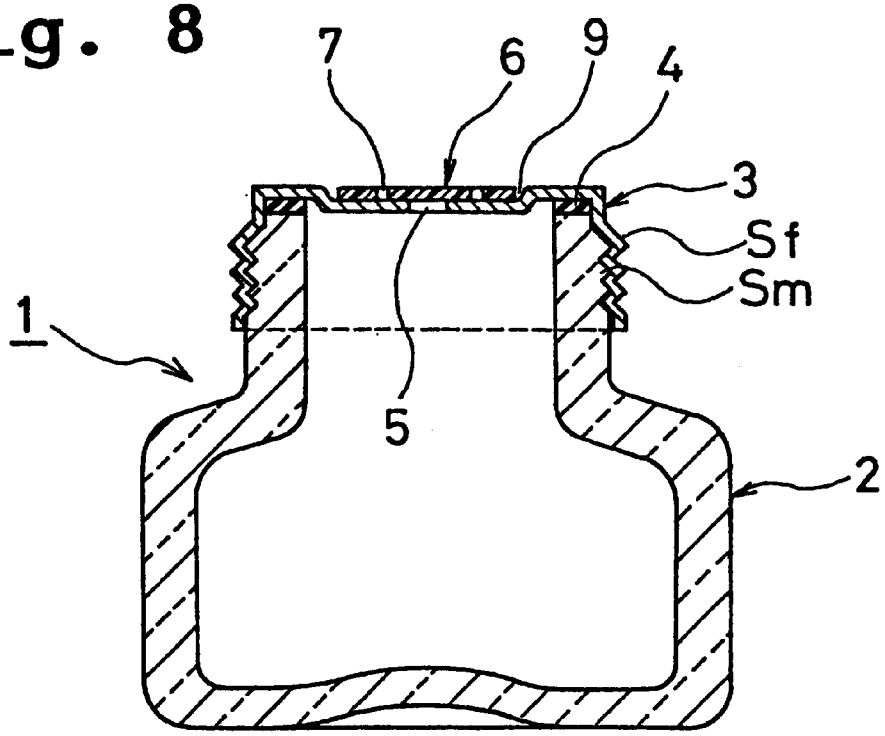
FIG. 8 is a vertical cross sectional view of a preservation container of a still further embodiment of the invention.

In FIG. 8, a container main body 2 is constituted by a bottle comprising transparent glass or plastics as similar to FIG. 7.

A concave part 9 is formed on the upper surface of a lid 3, and an opening 5 is provided at the substantial center of the concave part 9. A sheet for sealing 6 is arranged on the inside of the concave part 9 to cover the opening 5. The concave part 9 exhibits such a function that the positioning on arranging the sheet for sealing is made convenient, and when the interior is of a negative pressure, a contact material from the outside is difficult to be in contact with the sheet to protect the sheet for sealing. It also has such a function that the sheet for sealing 6 is retained on the upper surface of the container even after the negative pressure inside the container is disappeared.

According to the preservation container of the invention described in the foregoing, by reducing the pressure inside the container, the sealing property of the container main body and the lid is improved, invasion of miscellaneous bacteria into the container is prevented, and the increase of bacteria is prevented. Furthermore, because the remaining active oxygen in the container is reduced by the forced pressure reduction operation, the oxidation reaction of food and the like is delayed, so as to maintain freshness in a long period of time.

In the case of dry provisions, such as dry laver, medical herbs, dry food, confectionery and the like, powder, such as soybean flour and the like, and the like, which are liable to absorb moisture, are preserved, the absorb of moisture is suppressed, so as to maintain the taste thereof for a long period of time. Furthermore, the taste of the food and the like can be changed by making the interior of the container to have a negative pressure.

In the preservation container of the invention, because the sheet arranged on the outer surface of the lid is curved inside owing to the interior negative pressure, it can be easily known as to whether or not the package has been opened without permission during the preservation thereof by observing the presence or absence of the curved deformation. Because the lid cannot be easily opened with a small force by adhering the container main body and the lid by the negative pressure, the presence or absence of unauthorized opening can be known by the extent of the resistance force on opening.

In the case where a bottle is used as the container main body, to which a lid is screwed, another empty bottle can be used as the container main body as far as the screw part has the same dimension, and therefore an empty bottle, which has been wasted, can be effectively reused.

The sheet for sealing used in the preservation container of the invention may have arbitrary shape as far as it is curved and deformed at a position corresponding to the opening of the container and has a vent hole at a position offset the opening. For example, in addition to those exemplified in the embodiments described in the foregoing, examples shown in FIG. 9(A1) and (A2) to (E1) and (E2) can be shown.

Figure 9:
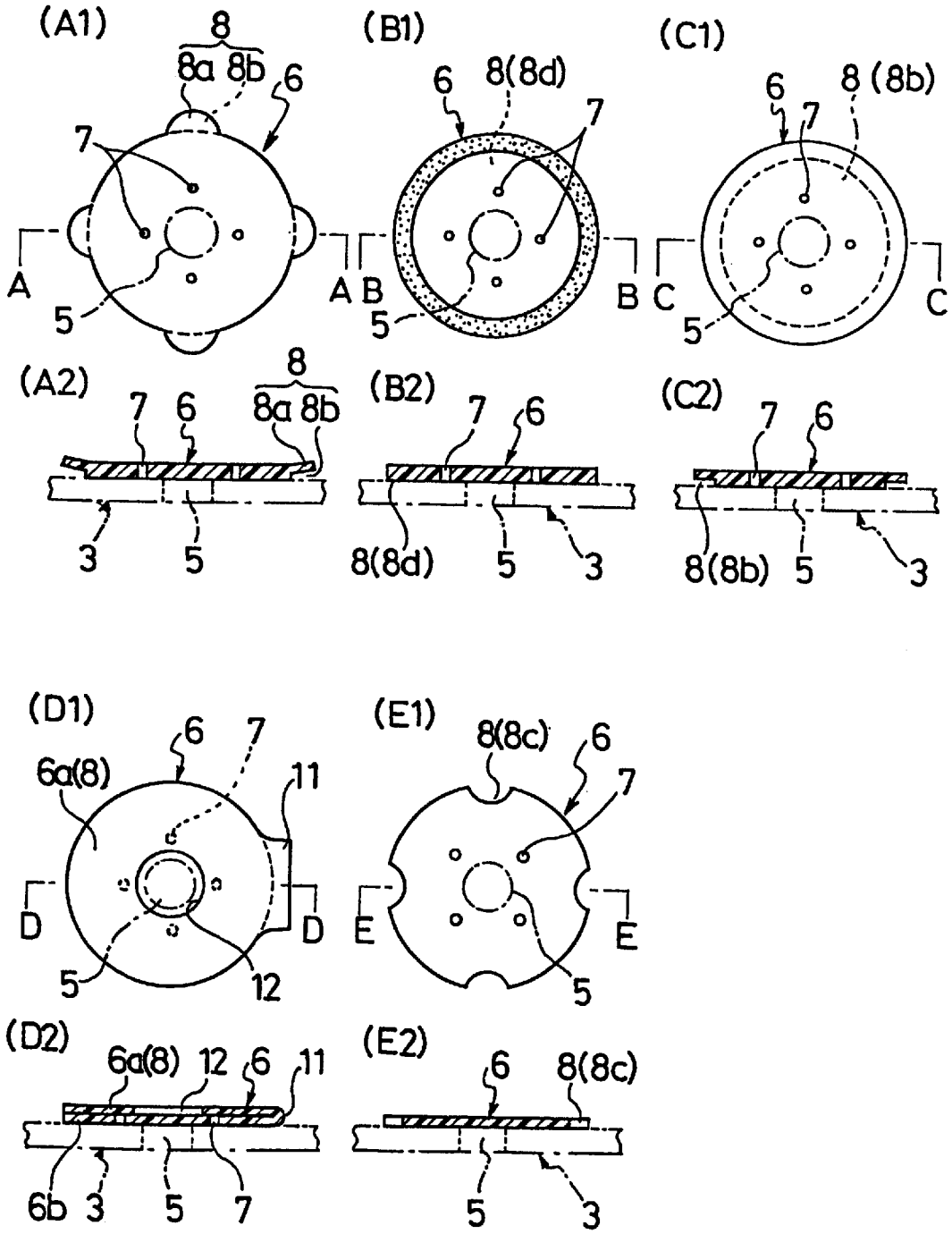
FIG. 9 shows examples of sheets for sealing used in the invention, in which (A1) to (E1) each is a plan view, and (A2) to (E2) each is a cross sectional view on line A—A, B—B, C—C, D—D or E—E in (A1) to (E1).

The embodiment of FIG. 9(A1) and (A2) comprises the sheet for sealing 6 used in the container for preserving prepared food of FIG. 1(A) and (B), in which the back surface of the protruded parts 8*a* as the peeling assistant parts 8 is removed to form thin parts 8*b*. By making the thin parts 8*b*, the peeling assistant parts 8 adhered on the upper surface of the lid 3 can be easily picked, so as to make the peeling of the sheet for sealing 6 easy.

The embodiment of FIG. 9(B1) and (B2) is a modified example of the sheet for sealing 6 used in the preservation container of FIG. 3(A) and (B). The vent holes 7 of the sheet for sealing 6 are provided four positions offset around the opening 5 arranged at the center part. The peeling assistant part 8 is the same as the case of FIG. 3(A) and (B) in the point where a satin finished rough surface 8*d* is provided on the back surface of the outer periphery of the sheet for sealing 6.

The embodiment of FIG. 9(C1) and (C2) is the case where the peeling assistant part 8 comprising only a thin part 8*b* is provided in the outer periphery of the sheet for sealing 6.

In the embodiment of FIG. 9(D1) and (D2), the sheet for sealing 6 is folded in two at a folding part 11 to be two-ply, so,as to cover the vent holes 7 with the upper sheet 6*a*. In this sheet for sealing 6, the four vent holes 7 are provided on the lower sheet 6*b* to surround the opening 5 of the container 1 (lid 3). Because the center part of the lower sheet 6*b* is curved and deformed corresponding to the opening 5, an opening 12 is provided at the center part of the upper sheet 6*a* whereby the curved deformation can be easily confirmed.

The upper sheet 6*a* is not folded upon conducting the pressure reduction operation for the container 1, and after completing the pressure reduction operation, it is folded onto the lower sheet 6*b*. The upper sheet 6*a* is also utilized as a peeling assistant part 8, which is picked and pulled upward, for peeling the sheet for sealing 6 from the container 1.

In the embodiment of FIG. 9(E1) and (E2), four notches 8*c* are provided as peeling assistant parts 8 on the outer periphery of the sheet for sealing 6.

In the invention, while it is not necessary to provide the peeling assistant part 8, the peeling operation of the sheet for sealing 6 can be easy by providing the same. When the peeling assistant part 8 is provided with a large area on the outer periphery of the sheet for sealing 6, the peeling becomes easier. However, when the area of the peeling assistant part 8 is too large, the peeling assistant part 8 is liable to be in contact with other members to cause wrinkles during the transportation and the like of the container 1, and there are cases where the wrinkles are caught by the other members, so that the whole of the sheet for sealing 6 is peeled. Thus, it is not preferred that the sheet is too large, which also causes increase in cost of the sheet.

According to the invention as described in the foregoing, since food and the like are contained in the preservation container in a negative pressure state, the amount of active oxygen inside the container is reduced to delay the oxidation spoilage of the food and the like and to prevent increase of bacteria, and therefore stable preservation in a long period of time can be realized. Because the sheet for sealing is in a curved and deformed state at the opening part of the lid during the preservation, it can be easily known as to whether or not the package is opened without permission during the preservation. Furthermore, the lid cannot be opened with a small force, and thus the presence or absence of the unauthorized opening can be known by the extent of the resistance force on opening.

When a bottle is used as the container main body, to which the lid is connected by screwing, an empty bottle, which has been a waste, can be reused as the container main body as far as the dimension of the screw part is the same, so as to contribute suppress of waste pollution.

EXAMPLE 1

By using a ½ hotel pan having a lid, the upper surface of which was mirror finished to have a surface roughness, plural containers 1 having a structure of FIG. 1(A) and (B), where a circular opening 5 having a diameter of 6 mm was provided at a part of the lid, were produced.

Separately, a silicone rubber sheet having a thickness of 1.5 mm that was formed to have a mirror surface having a surface roughness was cut to prepare plurality of two kinds of sheets for sealing 6 having or not having four protruded circular parts having a diameter of 50 mm 8*a* on the outer periphery. The sheets for sealing 6 were processed to have four vent holes 7 having a diameter of 1 mm at positions offset to the opening 5 by 5 mm or more when the sheet overlapped the opening 5*a* in a concentric manner.

Prepared foods, i.e., prepared curry, boiled beans, boiled fish, tempura and boiled meat, were put in the three containers 1 for each prepared food. The sheet for sealing 6 was put on each of the containers 1 to cover the opening 5, and the pressure of the interior was reduced by using a suction apparatus, so as to adhere and retain the sheet for sealing 6. Each of the sheets for sealing 6 was curved and deformed toward the inside at a position corresponding to the opening 5, which could be clearly confirmed by the naked eye.

During the containers 1 were stored in a refrigerator maintained at 4° C. for 72 hours, one of the three containers 1 for each of the prepared foods was taken out after the lapse of 35 hours. The lid 3 thereof was once opened, and the container was sealed without making the interior to have a negative pressure, followed by again being stored in the refrigerator.

After the lapse of 72 hours, all the containers were taken out from the refrigerator. In the containers having been taken out after the lapse of 35 hours, the whole of the sheets for sealing 6 were flat, and in the other containers, the state was maintained where the sheet was curved and deformed to a concave shape at the part of the opening 5. Therefore, all the containers that had been opened during the preservation could be easily distinguished.

Furthermore, among the containers maintaining the state where the sheet for sealing 6 was curved and deformed, the sheets 6 provided with protruded parts 8*a* (peeling assistant parts 8) could be easily peeled from the container, but the sheets without the same took more time to peel. In the containers maintaining the state where the sheet for sealing 6 was curved and deformed, general live bacteria, colon bacilli and the like were not present, and the freshness was maintained.

EXAMPLES 2 TO 7 AND COMPARATIVE EXAMPLES 1 TO 6

A preservation container comprising a glass bottle as a main body, a lid and a sheet for sealing having the following specifications was produced. Food samples described in Table 1 were put in the containers, and the pressure of the interior of the containers was reduced to about 500 mmHg (665 Pa), which were subjected to a preservation test at temperature conditions described in Table 1. (Examples 2 to 7)

For comparison, the same food samples were put in containers each comprising the same bottle main body as in Examples and an ordinary lid having no opening, which were subjected to a preservation test at the same temperature conditions described in Table 1.

COMPARATIVE EXAMPLES 1 TO 6

The results of the preservation tests are shown in Table 1. It is understood from the results of Table 1 that the foods of Examples 2 to 7 are substantially not spoiled in comparison to the same foods in the corresponding Comparative Examples 1 to 6.

(1) Bottle Main Body

Figure 6:
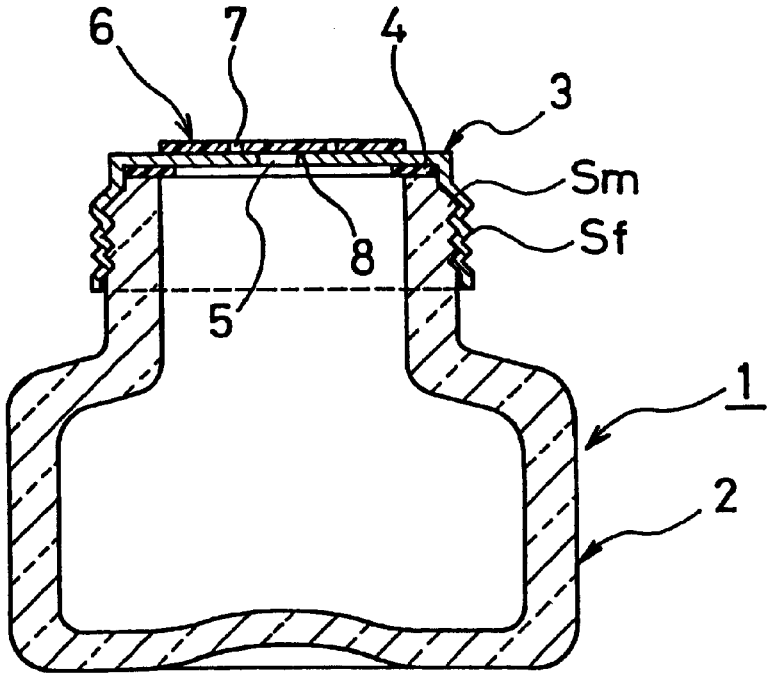
FIG. 6 is an example of a preservation container of a still further embodiment of the invention, in which (A) is a vertical cross sectional view, and (B) is a plan view.
Figure 6:
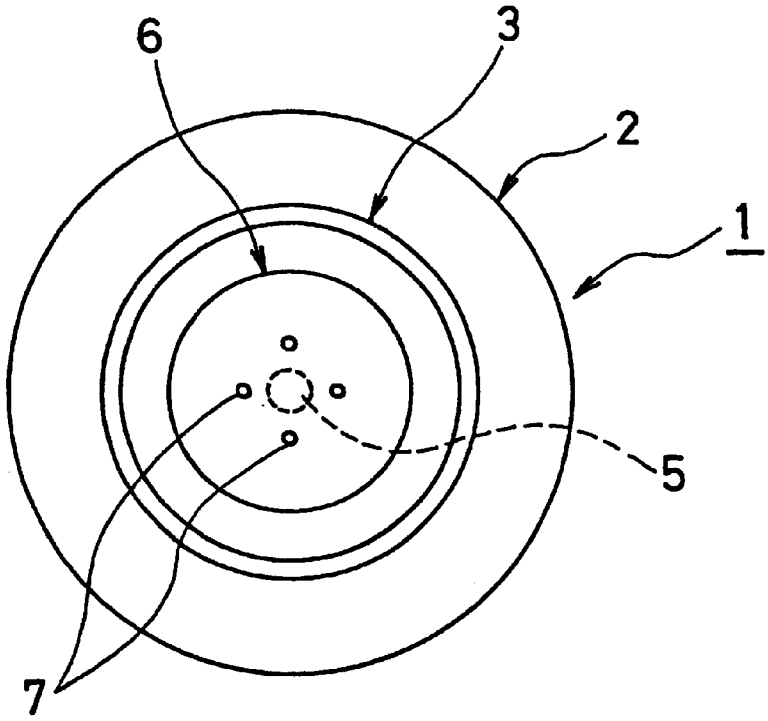

Structure: FIG. 6

Material: Heat resistant glass (transparent)

Dimension of bottle: inner diameter of main body×inner diameter of opening×height=118.3 mm×85.0 mm×184.0 mm (2) Lid Structure: FIG. 6

Material: Steel plate

Packing material: rubber made

Opening dimension: 4 mm in inner diameter

Chamfer: 1 mm in radius (3) Sheet

Material: Silicone rubber

Diameter: 50 mm

Thickness: 1.2 mm

Vent hole 7: 1 mm in diameter (six holes arranged in a concentric manner with a constant interval at positions distant from the center of the sheet by 12 mm)

TABLE 1

| | Food | Preservation temperature | Preservation result |
|---|---|---|---|
| Example 2 | raw shiitake mushroom | 4° C. in refrigerator | good after 6 days |
| Comparative Example 1 | raw shiitake mushroom | 4° C. in refrigerator | spoiled after 3 days |
| Example 3 | raw cherry | 4° C. in refrigerator | good after 7 days |
| Comparative Example 2 | raw cherry | 4° C. in refrigerator | spoiled after 3 days |
| Example 4 | raw plum | 4° C. in refrigerator | good after 10 days |

TABLE 1-continued

| | Food | Preservation temperature | Preservation result |
|---|---|---|---|
| Comparative example 3 | raw plum | 4° C. in refrigerator | spoiled after 3 days |
| Example 5 | sheet laver | left at normal temperature | good after 2 months |
| Comparative Example 4 | sheet laver | left at normal temperature | moist after 10 days |
| Example 6 | rice cracker | left at normal temperature | good for 1 month or more |
| Comparative Example 5 | rice cracker | left at normal temperature | moist after 10 days |
| Example 7 | rice cake | left at normal temperature | without mold for 5 days |
| Comparative Example 6 | rice cake | left at normal temperature | mold after 2 days |

EXAMPLE 8 AND COMPARATIVE EXAMPLE 7

By using the glass bottle container of the invention used in Examples 2 to 7 and the conventional glass bottle container used in Comparative Examples 1 to 6, a preservation test of boiled vegetables was conducted by reducing the pressure to about 500 mmHg (665 Pa) in Example 8 and at an atmospheric pressure in Comparative Example 7.

EXAMPLE 8 AND COMPARATIVE EXAMPLE 7

As a result, in the preservation test of Example 8, preservation could be conducted without spoilage for a preservation period of about 2.5 times that of Comparative Example 7.

EXAMPLES 9 AND 10

Japanese sake and shochu each was put in a glass bottle container of the invention used in Examples 2 to 7 to an amount of about half of the bottle content, and the pressure was reduced to about 500 mmHg (665 Pa). After small bubbles were released from the liquid, the reduced pressure was cancelled, and tasting was conducted. As a result, the taste became delicate in comparison to the original Japanese sake and shochu, and the good taste was increased.

EXAMPLE 11

Strawberry jam was put in a glass bottle container of the invention used in Examples 2 to 7 to an amount of about half of the bottle content, and the pressure was reduced to about 500 mmHg (665 Pa). One day after, the reduced pressure was cancelled, and tasting was conducted. As a result, strong sweetness was relaxed and changed to smooth sweetness.

Industrial Applicability

The invention can be used as a container for preserving food, a medical drug and the like for a long period of time. Because a bottle and the like, which have been to be wasted, can be effectively utilized, it can contribute to the reduction of waste pollution.

What is claimed is:

1. A preservation container for food comprising a container composed of a container main body and a sealable lid having an opening at a part thereof, and a gas non-permeable sheet arranged separably outside said opening on an outer surface of said lid, said sheet having an area larger than said opening, a vent hole at a position offset to said opening, wherein said sheet is positioned in facial, frictional contact with a flat surface of the lid to cover the opening without using an adhesive material between the sheet and the flat surface of the lid, said sheet is curved and deformed at a part corresponding to said opening, and a peripheral part thereof around said opening is adhered and maintained on a surface of said container by pressure reduction of an interior of said container.

2. A preservation container for food as claimed in claim 1, wherein said container main body comprises a bottle comprising one of glass and plastics.

3. A preservation container for food as claimed in claim 1, wherein a concave part is formed on an upper surface of said lid to contain said opening, and said sheet is contained in said concave part.

4. A preservation container for food as claimed in claim 1, wherein said lid comprises a packing material seal, wherein said lid is capable of being attached to and removed from said container main body having a dimension corresponding to said lid.

5. A preservation container for food as claims in claim 1, wherein said sheet is formed from a material chosen from a group including a silicone rubber, a thermoplastic polymer elastomer, a synthetic rubber, and a natural rubber, wherein said sheet has a thickness in a range of 0.5 mm to 3 mm.

6. A lid member for sealing of a preservation container for food comprising a combination of a lid capable of being attached and removed on a sealable container main body, and a gas non-permeable sheet arranged separably on an outer surface of said lid , wherein an opening connecting an inside of said lid and an outside is provided at a position where said lid is covered with said sheet, a vent hole is provided on said sheet at a position offset to said opening, and when a pressure inside said container main body is reduced, a part of said sheet corresponding to said opening is curved and deformed toward an inside, and a part thereof around said opening is adhered in frictional contact with and retained on an outer surface of said lid without using an adhesive material between the sheet and the flat surface of the lid.

7. A lid member for sealing of a preservation container for food as claimed in claim 6, wherein a concave part is formed on an upper surface of said lid to contain said opening, and said sheet is contained in said concave part.

8. A lid member for sealing of a preservation container for food as claimed in claim 6, wherein said lid comprises a transparent material.

9. A lid member for sealing of a preservation container for food as claimed in claim 6, wherein said sheet is formed from a material chosen from a group including a silicone rubber, a thermoplastic polymer elastomer, a synthetic rubber, and a natural rubber, wherein said sheet has a thickness in a range 0.5 mm to 3 mm.

10. A sheet for sealing of a preservation container for food comprising a gas non-permeable sheet arranged separably outside an opening provided on an outer surface of a lid of a sealable container, having an area larger than said opening, having a vent hole at a position offset to said opening, wherein when a pressure inside said container is reduced, a part of said sheet corresponding to said opening is curved and deformed, and a part thereof around said opening is adhered in frictional contact with and retained on a surface of said container without using an adhesive material between the sheet and the part of the sheet around the opening.

11. As sheet for sealing of preservation container for food as claimed in claim 10, wherein said sheet is formed from a material chosen from a group including a silicone rubber, a thermoplastic polymer elastomer, a synthetic rubber, and a natural rubber, wherein said sheet has a thickness of 0.5 mm to 3 mm.

* * * * *